US011396781B2

(12) United States Patent
Webb et al.

(10) Patent No.: US 11,396,781 B2
(45) **Date of Patent: *Jul. 26, 2022**

(54) DIVERTER FOR DRILLING OPERATION

(71) Applicant: Equipment Resources International, Inc., Katy, TX (US)

(72) Inventors: David Webb, Katy, TX (US); Richard Romero, Broussard, LA (US)

(73) Assignee: Equipment Resources International, Inc., Katy, TX (US)

( * ) Notice: Subject to any disclaimer, the term of this patent is extended or adjusted under 35 U.S.C. 154(b) by 306 days.

This patent is subject to a terminal disclaimer.

(21) Appl. No.: 16/752,621

(22) Filed: Jan. 25, 2020

(65) Prior Publication Data

US 2020/0157896 A1 May 21, 2020

Related U.S. Application Data

(63) Continuation of application No. 15/229,589, filed on Aug. 5, 2016, now Pat. No. 10,557,324.

(60) Provisional application No. 62/201,362, filed on Aug. 5, 2015.

(51) Int. Cl.
*E21B 21/08* (2006.01)
*E21B 33/03* (2006.01)

(52) U.S. Cl.
CPC ..... *E21B 21/08* (2013.01); *E21B 33/03* (2013.01)

(58) Field of Classification Search
CPC ..... E21B 21/00; E21B 21/001; E21B 21/082; E21B 21/08; E21B 33/12
See application file for complete search history.

(56) References Cited

U.S. PATENT DOCUMENTS 7,997,345 B2 * 8/2011 Hannegan ..... E21B 33/085 175/57
2014/0367082 A1 * 12/2014 Gamble ..... E21B 33/038 166/88.1

* cited by examiner

*Primary Examiner* — Robert E Fuller
*Assistant Examiner* — Lamia Quaim
(74) *Attorney, Agent, or Firm* — Park, Vaughan, Fleming & Dowler LLP; Shane Nelson

(57) ABSTRACT

A diverter assembly may include a diverter body assembly. The diverter body assembly may also include a diverter body, the diverter body fluidly coupled to the annulus of a wellbore via a casing or riser, and the diverter body including one or more diverter outlet ports fluidly coupled to the annulus of the wellbore. The diverter body assembly may also include an upper packer assembly. The upper packer assembly may include a packer sleeve, the packer sleeve mechanically coupled to the diverter body. The packer sleeve may include one or more breach lock slots. The upper packer assembly may also include an upper packer body having one or more packer breach lock tabs engaged with the breach lock slots of the packer sleeve. The diverter assembly may also include a diverter support housing, the diverter support housing coupled to the diverter body assembly.

15 Claims, 12 Drawing Sheets

DIVERTER FOR DRILLING OPERATION

CROSS-REFERENCE TO RELATED APPLICATIONS

The present application is a continuation of U.S. application Ser. No. 15/229,589, filed on Aug. 5, 2016, which claims priority to U.S. provisional patent application No. 62/201,362, filed on Aug. 5, 2015. The entire contents of each of the above documents is hereby incorporated herein by reference.

FIELD OF THE DISCLOSURE

The present disclosure relates to diverters for drilling operations.

BACKGROUND OF THE DISCLOSURE

While drilling a wellbore, a diverter may be positioned to divert any high pressure fluid resulting from, for example, a blowout, away from the drilling floor. A diverter may couple to an upper end of a casing or a riser and be positioned about the drill string as the wellbore is drilled. Traditionally, the diverter is positioned beneath the drill floor or rotary table and includes one or more outlets that may be coupled to exhaust conduits away from the drill floor.

SUMMARY

The present disclosure provides for a diverter assembly. A diverter assembly includes a diverter body assembly. The diverter body assembly includes a diverter body, the diverter body fluidly coupled to the annulus of a wellbore via a casing or riser, and the diverter body including one or more diverter outlet ports fluidly coupled to the annulus of the wellbore. The diverter body assembly also includes an upper packer assembly. The upper packer assembly includes a packer sleeve, the packer sleeve mechanically coupled to the diverter body. The packer sleeve includes one or more breach lock slots. The upper packer assembly also includes an upper packer body having one or more packer breach lock tabs engaged with the breach lock slots of the packer sleeve. The diverter assembly also includes a diverter support housing, the diverter support housing coupled to the diverter body assembly.

The present disclosure also provides for a method. The method includes providing a diverter body assembly including a diverter body, the diverter body fluidly coupled to the annulus of a wellbore via a casing or riser, and the diverter body including one or more diverter outlet ports fluidly coupled to the annulus of the wellbore. The method also includes coupling a packer sleeve to the diverter body, and inserting an upper packer body into the packer sleeve such that one or more packer breach lock tabs of the upper packer body engage one or more corresponding breach lock slots of the packer sleeve. The method additionally includes rotating the upper packer body to a closed position such that the breach lock slots retain the upper packer body to the packer sleeve and sealing, with the upper packer body, between the diverter body and a drill string passing therethrough.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
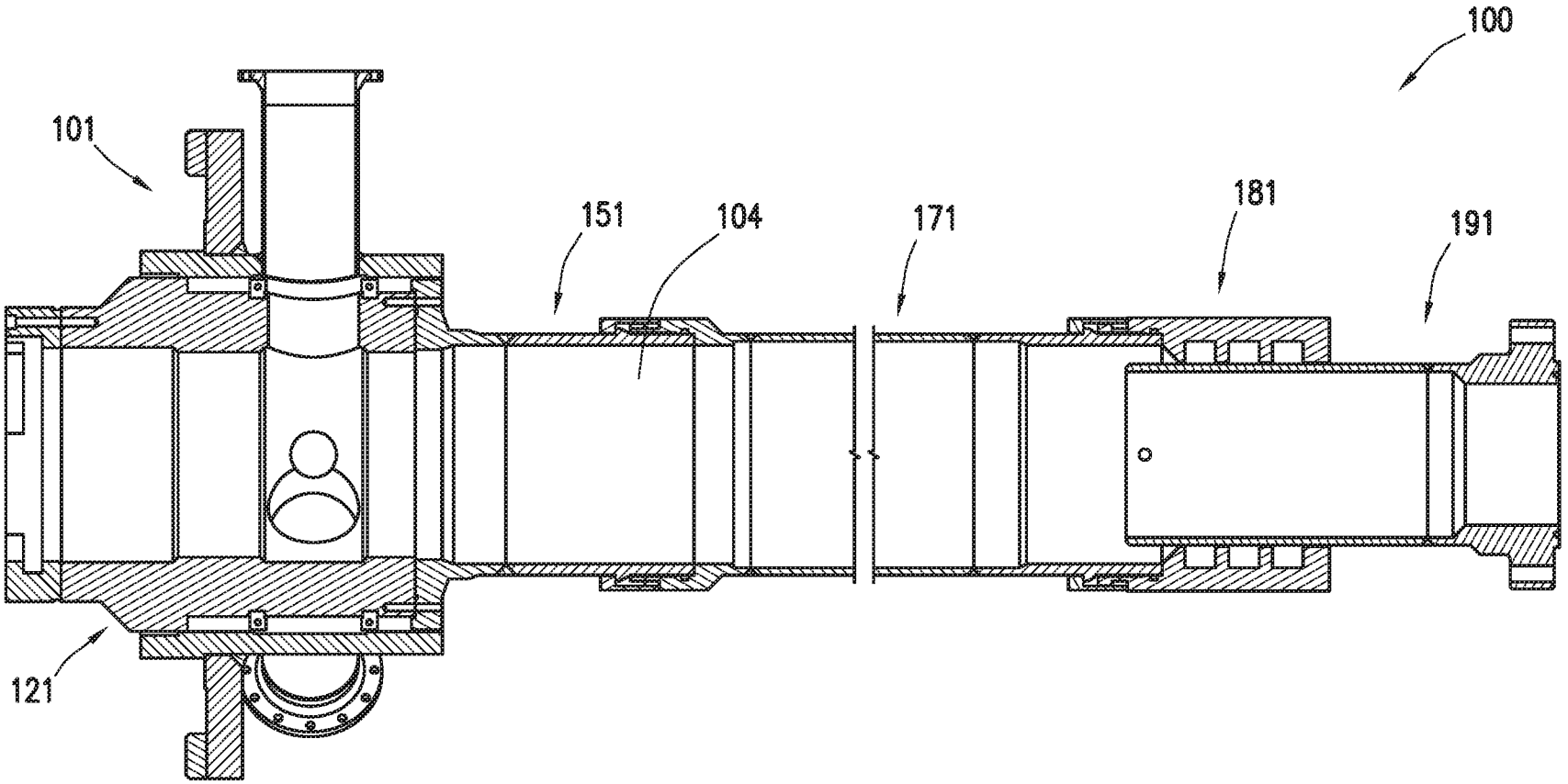
FIG. 1 depicts a cross section view of a diverter assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a cross section of diverter assembly 100 consistent with at least one embodiment of the present disclosure. In some embodiments, diverter assembly 100 may include diverter support housing 101. Diverter support housing 101 may be mechanically coupled to a drill floor (not shown) or other component of a drilling rig by, for example and without limitation, one or more structural beams underneath and supporting the drill floor. Diverter support housing 101 may be mechanically coupled to diverter body assembly 121. Diverter assembly 100 further includes diverter lower assembly 151, spacer spool pipe 171 and overshot housing 181. Diverter body assembly 121 may be mechanically coupled to diverter lower assembly 151, which may be mechanically coupled to spacer spool pipe 171. Spacer spool pipe 171 may be mechanically coupled to overshot housing 181. Diverter body assembly 121, diverter lower assembly 151, spacer spool pipe 171, and overshot housing 181 may each be generally tubular and may form diverter assembly bore 104 therethrough. In some embodiments a drill string (not shown) may extend through diverter assembly bore 104. Overshot housing 181 may fit around a tubular such as a riser or a portion of casing such that diverter assembly bore 104 is coupled to the annulus of the wellbore via the riser or portion of casing.

Figure 2:
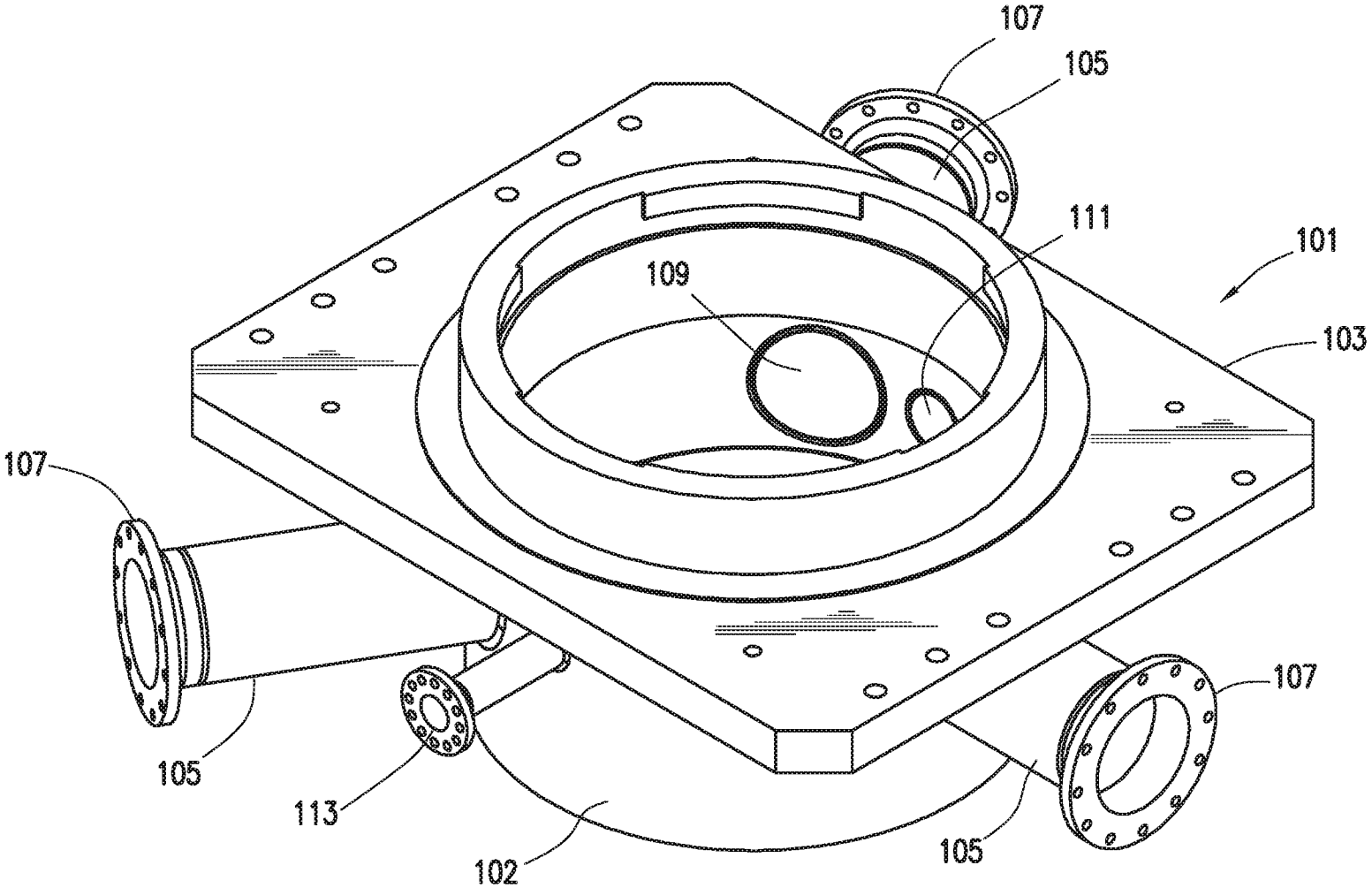
FIG. 2 depicts a perspective view of a diverter support housing consistent with at least one embodiment of the present disclosure.
Figure 4:
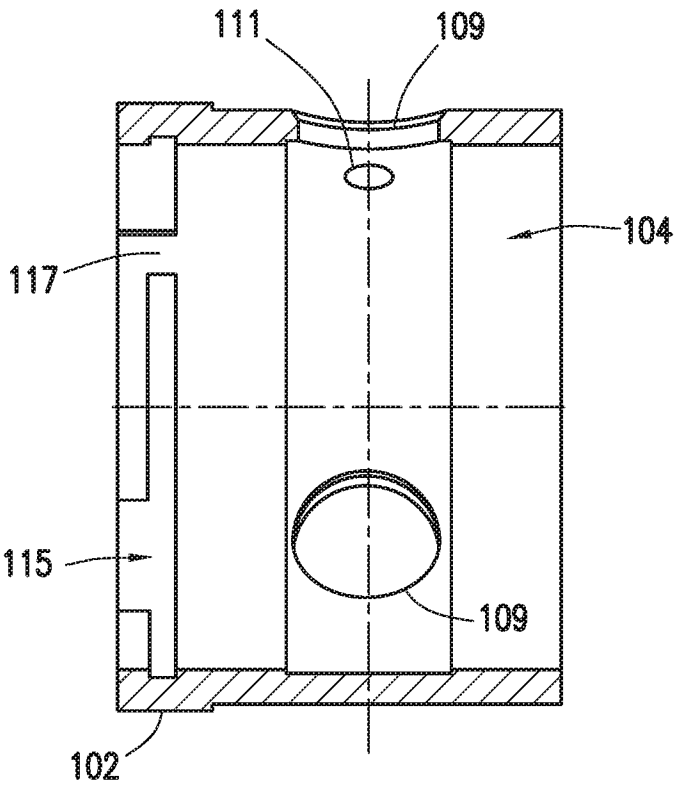
FIG. 4 depicts a cross section view of the housing cylinder of FIG. 3.
Figure 3:
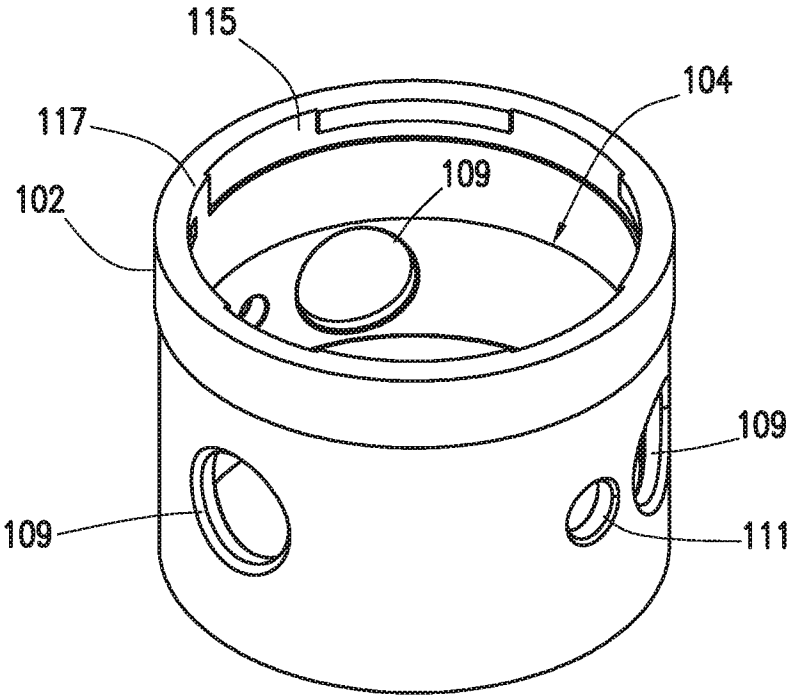
FIG. 3 depicts a perspective view of the housing cylinder of the diverter support housing of FIG. 2.

In some embodiments, as depicted in FIGS. 2-4, diverter support housing 101 may include housing cylinder 102. Housing cylinder 102 may be coupled to base plate 103 as shown in FIG. 2. Base plate 103 mechanically couples diverter support housing 101 to the drilling rig. In some embodiments, one or more outlet pipes may be fluidly connected to diverter assembly bore 104. In some embodiments, outlet pipes 105 may be formed at least partially in diverter support housing 101. During operation, one or more outlet pipes 105 may conduct fluid from diverter assembly bore 104, which is fluidly connected to the interior of diverter assembly 100 as discussed herein below. In some embodiments, outlet pipes 105 may include couplers adapted to couple to exhaust conduits, allowing fluids to be routed to locations away from the drilling rig. For example and without limitation, the couplers may be flange couplings 107 as shown in FIG. 2, though one having ordinary skill in the art with the benefit of this disclosure will understand that any pipe coupling may be used without deviating from the scope of this disclosure. Outlet pipes 105 (shown removed in FIGS. 3, 4) may couple to outlet ports 109 formed in housing cylinder 102. In some embodiments, inlet ports 111 may be fluidly coupled to inlet pipes 113 to, for example, allow fluid to be introduced into housing cylinder 102.

As shown in FIGS. 3 and 4, in some embodiments, housing cylinder 102 may include housing breach lock slots 115. Housing breach lock slots 115 may, as understood in the art, allow one or more corresponding breach lock tabs 123 (FIG. 5) from diverter body assembly 121 to axially enter thereinto and, upon rotation of diverter body assembly 121, axially lock diverter body assembly 121 to diverter support housing 101. In some embodiments, housing breach lock slots 115 may include rotation stop 117 to retard further rotation of diverter body assembly 121 when in a locked position. Likewise, rotation of diverter body assembly 121 in the opposite direction may move breach lock tabs 123 into an open position, to allow diverter body assembly 121 to be axially removed from diverter support housing 101. Rotation stop 117 may in some embodiments retard rotation of diverter body assembly 121 in both rotational directions.

Figure 5:
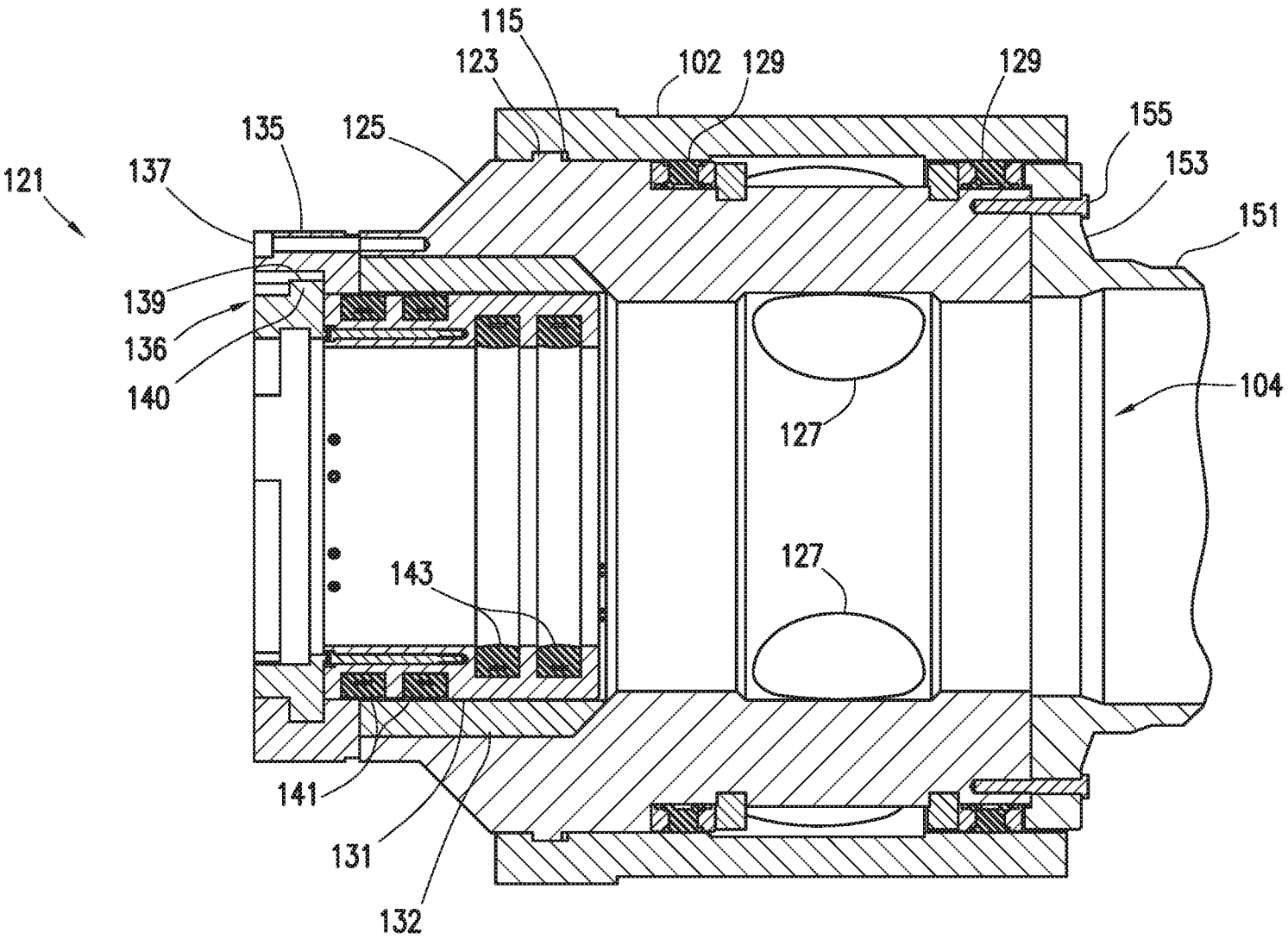
FIG. 5 depicts a cross section view of a diverter body assembly consistent with at least one embodiment of the present disclosure.
Figure 6:
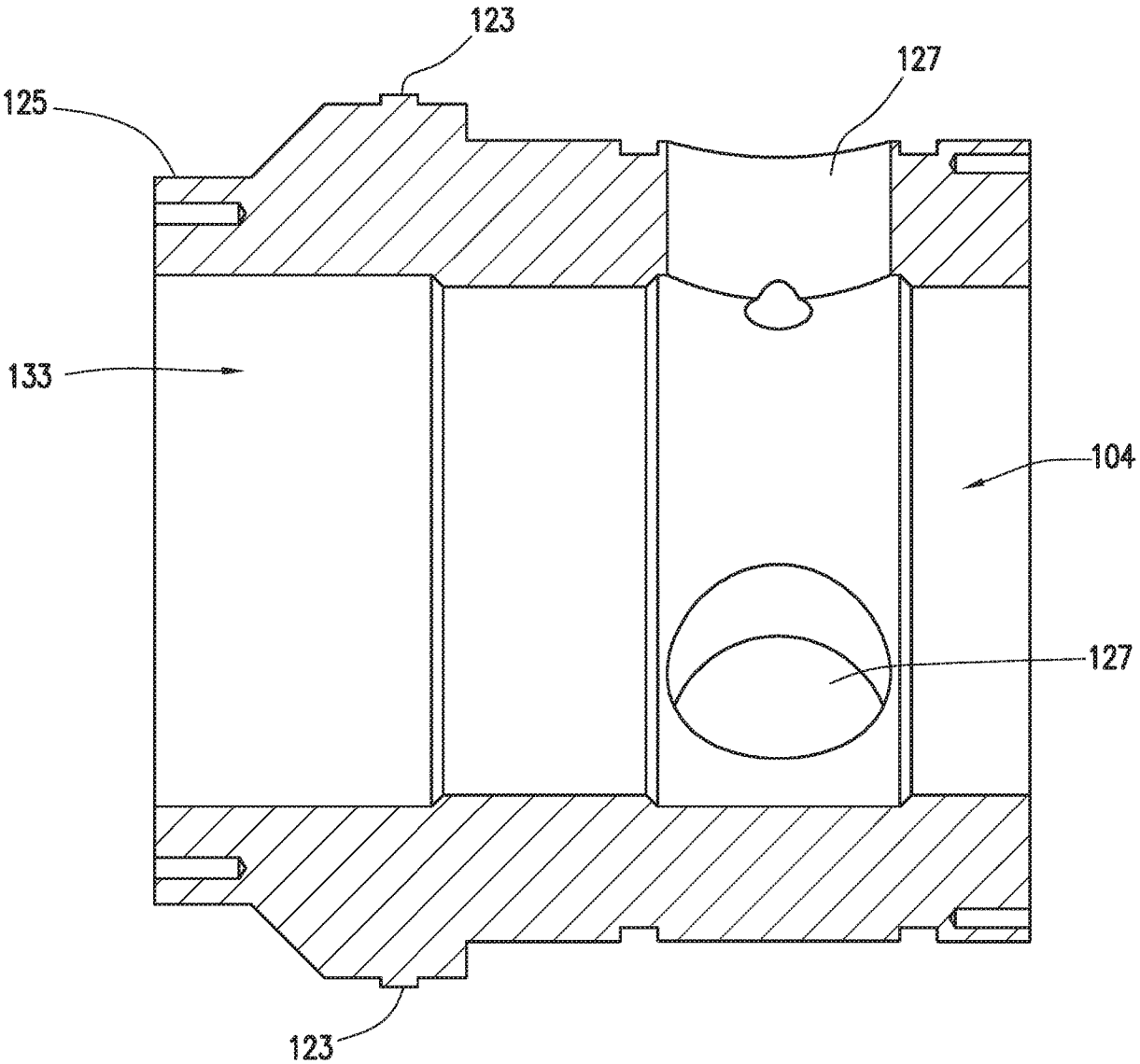
FIG. 6 depicts a cross section view of a diverter body of the diverter assembly of FIG. 5.
Figure 7:
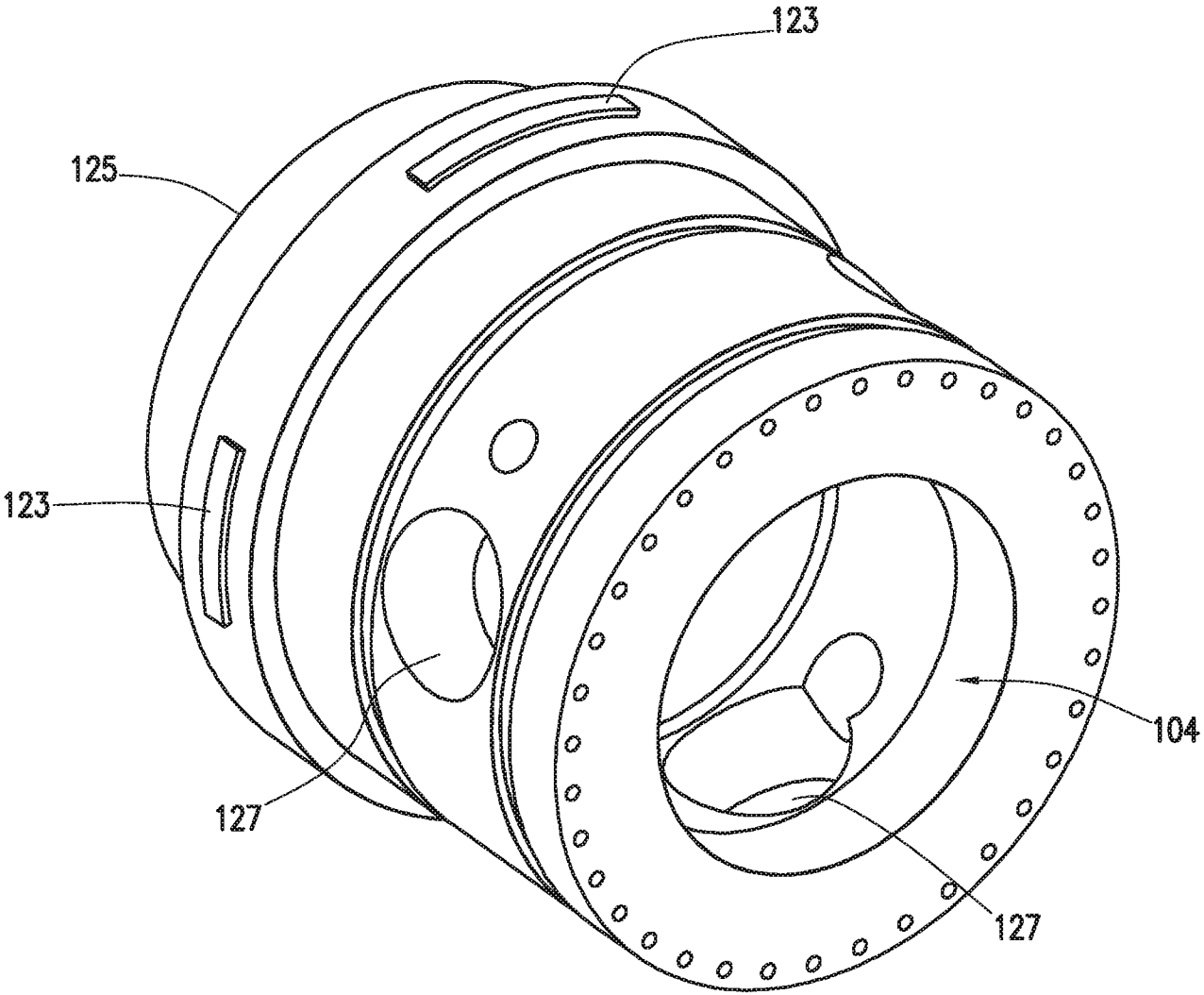
FIG. 7 depicts a perspective view of the diverter body of FIG. 6.

As depicted in FIGS. 5 and 6, in some embodiments, diverter body assembly 121 may include diverter body 125. Diverter body 125 may include one or more diverter outlet ports 127, corresponding with outlet ports 109 of diverter support housing 101 thereby fluidly coupling diverter outlet ports 127 to outlet pipes 105 and the annulus of a wellbore. In some embodiments, as depicted in FIG. 5, one or more seals 129 may be positioned between diverter body 125 and housing cylinder 102 to, for example and without limitation, provide a fluid seal between diverter outlet ports 127 and outlet ports 109. In some embodiments, diverter body 125 may be fluidly coupled to the annulus of a wellbore via a casing or riser.

Figure 8:
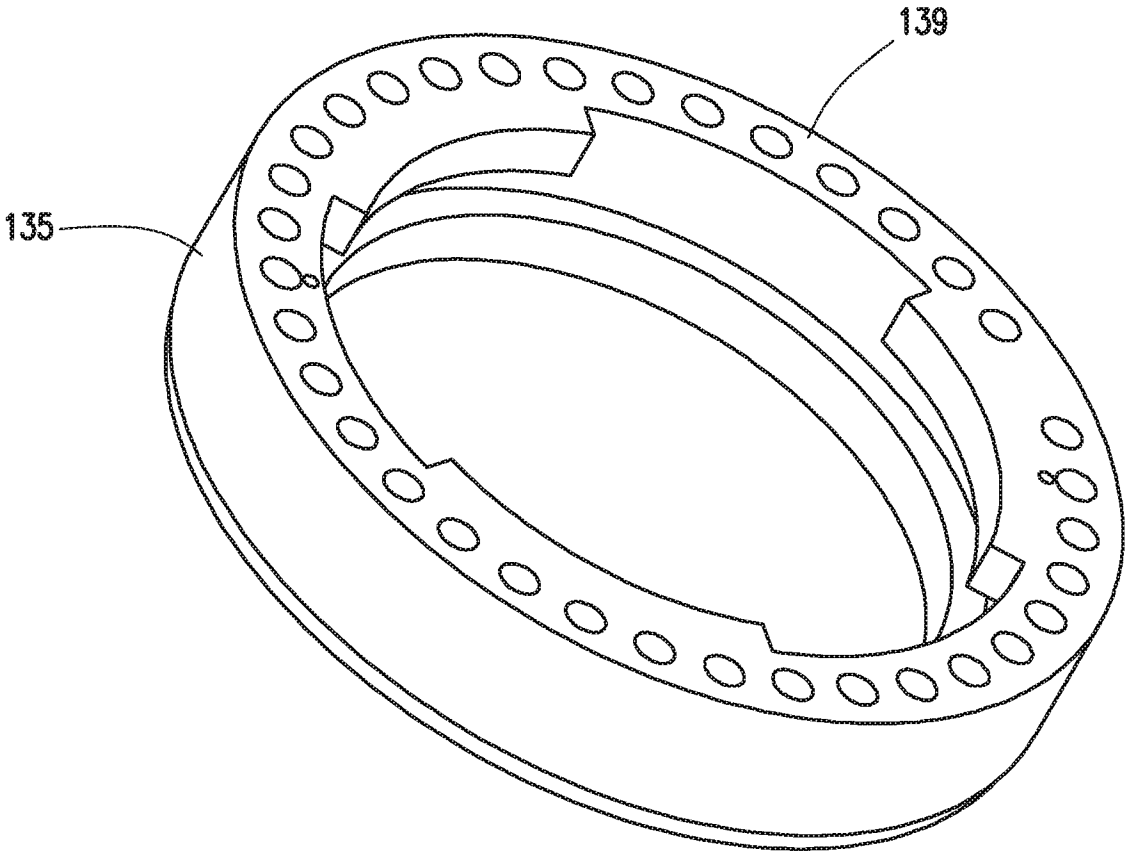
FIG. 8 depicts a diverter upper retainer of the diverter assembly of FIG. 5.

In some embodiments, diverter body assembly 121 may include upper packer assembly 131. Upper packer assembly 131 may form a fluid seal between diverter body 125 and a drill string (not shown) passing therethrough. Upper packer assembly 131 may include packer sleeve 132. Packer sleeve 132 may fit within packer recess 133 (shown in FIG. 6) within diverter body 125. Packer sleeve 132 may, in some embodiments, be coupled to diverter body 125 by, for example and without limitation, threaded fasteners such as bolts 137. Upper packer assembly 131 may include upper packer body 136 adapted to fit within packer sleeve 132. Upper packer body may be annular. In some embodiments, upper packer body 136 may be inserted into or removed from packer sleeve 132 in an axial direction. In some embodiments, upper packer body 136 may be coupled to packer sleeve 132 and thus to diverter body 125 by upper retainer 135. In some embodiments, upper retainer 135 may include one or more breach lock slots 139 (shown in detail in FIG. 8) corresponding to one or more corresponding breach lock tabs 140 positioned on an end of upper packer body 136 to allow upper packer body 136 to couple thereto as upper packer body 136 is rotated into a closed position from the open position used to insert upper packer body 136 into packer sleeve 132.

Figure 5A:
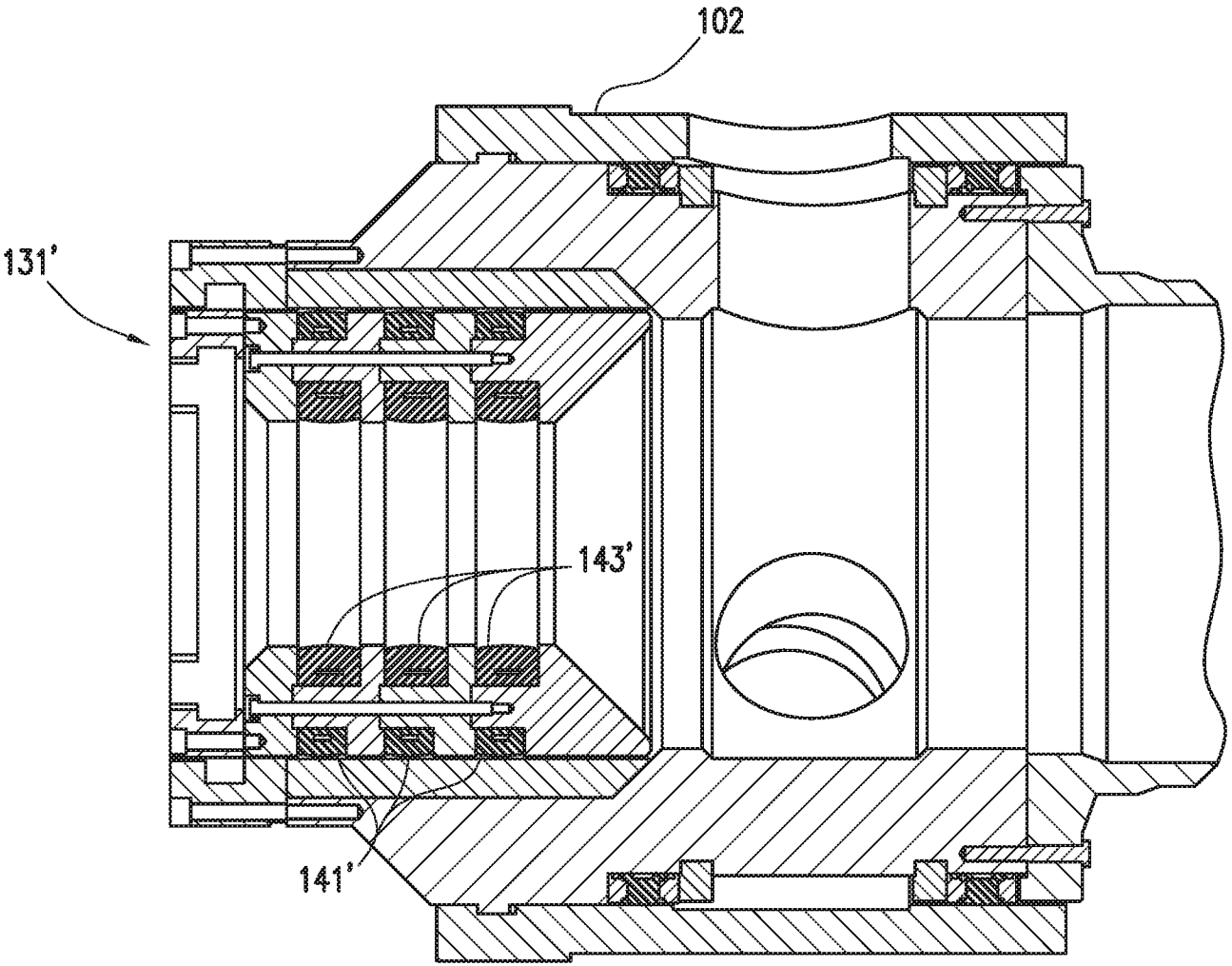
FIG. 5A depicts a cross section view of a diverter body assembly consistent with at least one embodiment of the present disclosure.
Figure 5B:
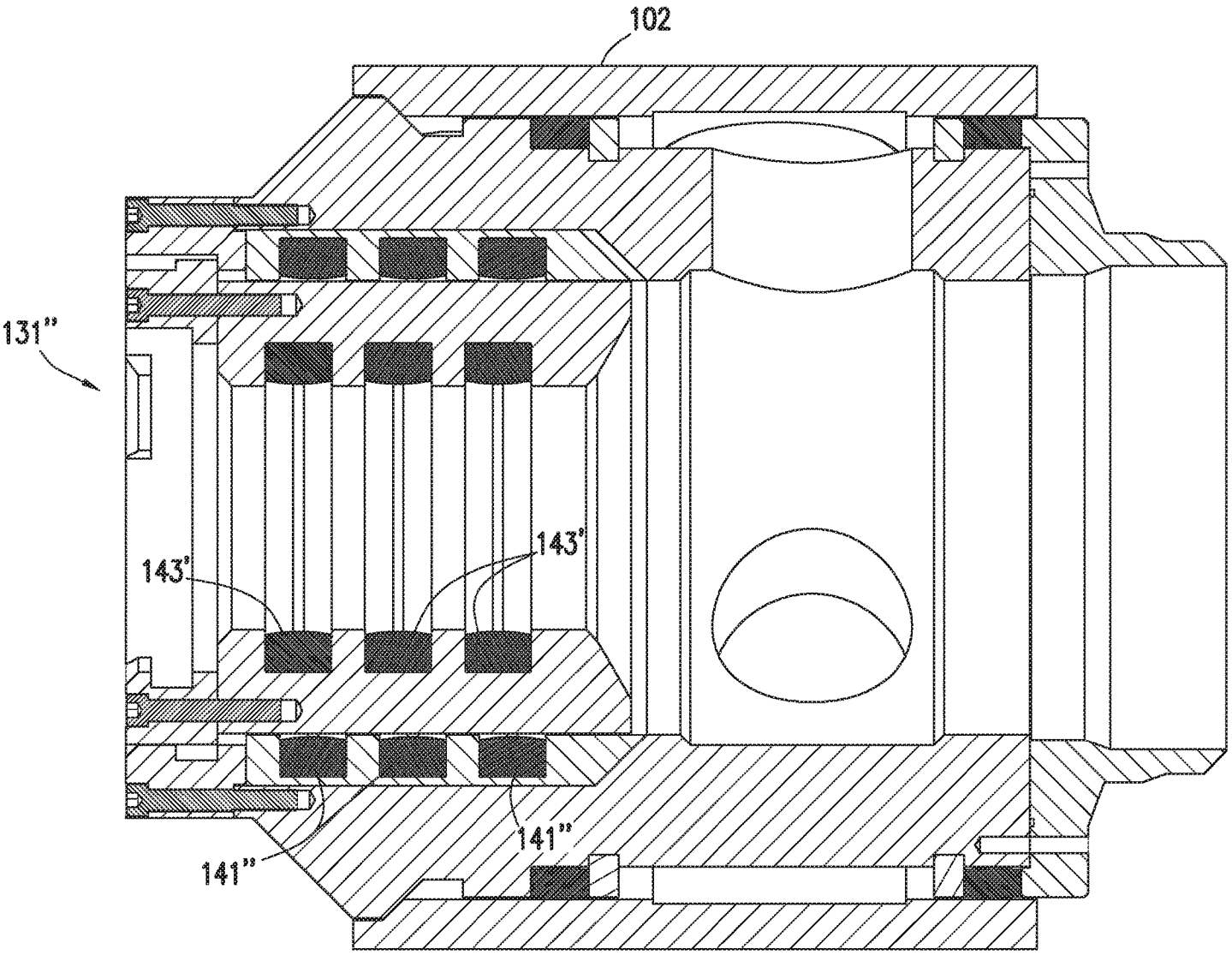
FIG. 5B depicts a cross section view of a diverter body assembly consistent with at least one embodiment of the present disclosure.
Figure 5C:
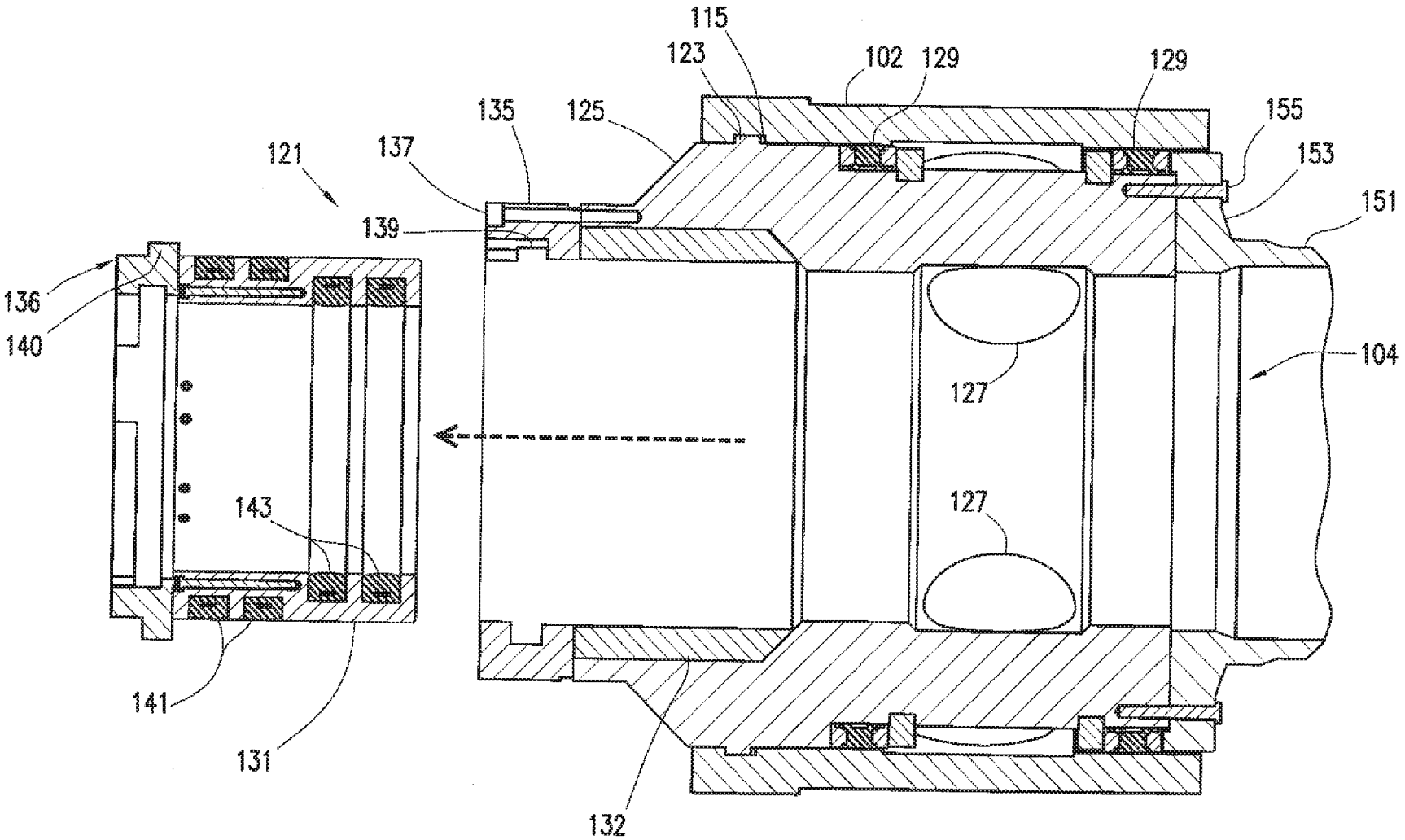
FIG. 5C depicts a cross section view of a diverter body assembly consistent with at least one embodiment of the present disclosure.

In some embodiments, as depicted in FIG. 5, upper packer assembly 131 may include two outer seals 141 coupled to upper packer body 136. Outer seals 141 may provide a fluid seal between upper packer assembly 131 and diverter body 125. In some embodiments, upper packer assembly 131 may include two inner seals 143 coupled to upper packer body 136. Inner seals 143 may provide a fluid seal between upper packer assembly 131 and a drill string (not shown) during a drilling operation. In some embodiments, outer seals 141 and inner seals 143 may be fluid actuated to extend and seal between the respective members. In some such embodiments, outer seals 141 and inner seals 143 may be, for example and without limitation, inflatable seals. In some embodiments, outer seals 141 and inner seals 143 may be inflated simultaneously or may be selectively inflated independently. In some embodiments, outer seals 141 and inner seals 143 may be inflated by one or more ports. In some embodiments, inner seals 143 may provide a fluid seal against multiple diameters or pipe sizes of a drill string. One having ordinary skill in the art with the benefit of this disclosure will understand that any number of outer seals 141 and inner seals 143 may be utilized without deviating from the scope of this disclosure. For example, in some embodiments, as depicted in FIG. 5A, upper packer assembly 131' may include three outer seals 141' and three inner seals 143'. In some embodiments, outer seals 141' may be positioned as part of upper packer assembly 131'. In some embodiments, as depicted in FIG. 5B, outer seals 141" may be positioned as part of packer sleeve 132' positioned within diverter body 125 as previously discussed. In such an embodiment, outer seals 141" may seal against upper packer assembly 131".

Stresses on outer seals 141 and inner seals 143 may cause the seals to deteriorate. In order to service or replace seals 141, 143, upper packer body 136 may be removed from the rest of diverter body assembly 121. In some such embodiments, upper packer body 136 may be rotated such that breach lock tabs 140 are aligned with breach lock slots 139 in an unlocked position, allowing upper packer body 136 to be axially removed from diverter body assembly 121. Replacement may similarly be accomplished by axially inserting upper packer body 136 into diverter body assembly 121 and rotating upper packer body 136 until breach lock tabs 140 are in a locked position within breach lock slots 139.

Figure 9:
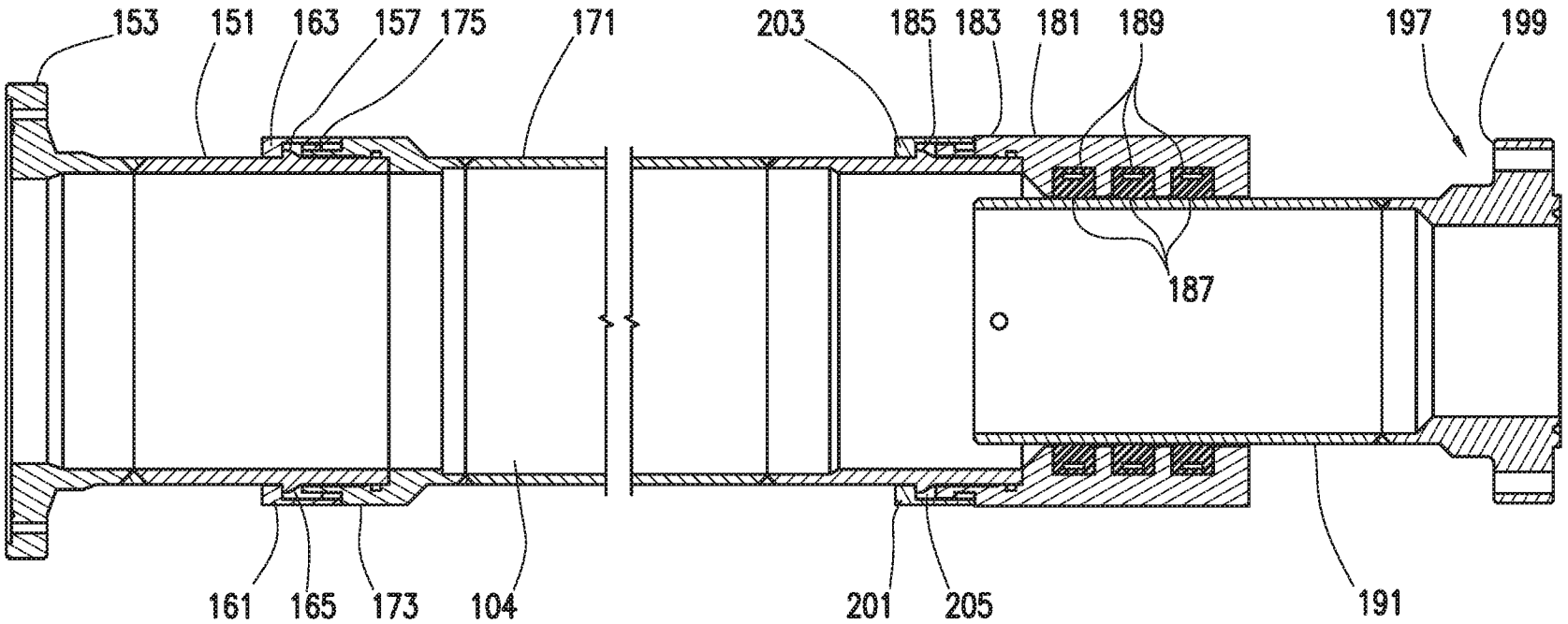
FIG. 9 depicts a cross section of a diverter lower assembly, spacer spool, overshot, and mandrel consistent with at least one embodiment of the present disclosure.
Figure 10:
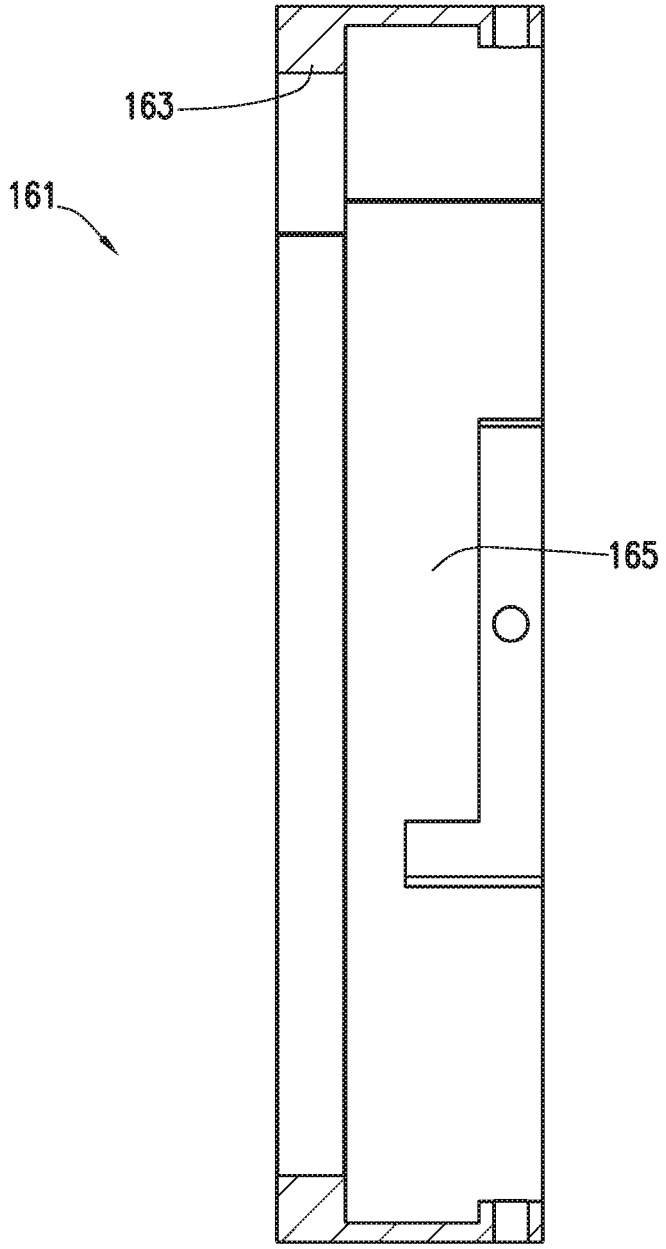
FIG. 10 depicts a lock ring consistent with at least one embodiment of the present disclosure.

In some embodiments, as shown in FIG. 5, diverter lower assembly 151 may couple to the lower end of diverter body 125. In some embodiments, diverter lower assembly 151 may couple to diverter body 125 by a breach-lock assembly as described herein. In some embodiments, diverter lower assembly 151 may include mounting flange 153 to mechanically couple diverter lower assembly 151 to the lower end of diverter body 125 by, for example and without limitation, threaded fasteners such as bolts 155. Diverter lower assembly 151 may be a tubular member. As depicted in FIG. 9, diverter lower assembly 151 may include a breach lock assembly including lock ring retainer 157. Lock ring retainer 157 may be a generally annular protrusion from the exterior surface of diverter lower assembly 151. Lock ring retainer 157 may, for example, retain lock ring 161 to diverter lower assembly 151. As depicted in FIG. 10, lock ring 161 may include retaining flange 163 adapted to contact lock ring retainer 157 and prevent lock ring 161 from sliding off the end of diverter lower assembly 151. Lock ring 161 may further include breach lock slots 165 to couple to spacer spool pipe 171 and between spacer spool pipe 171 and overshot housing 181 as discussed herein.

In some embodiments, diverter lower assembly 151 may couple to spacer spool pipe 171 as depicted in FIG. 9. In some embodiments, spacer spool pipe 171 may include upper coupler 173. In some embodiments upper coupler 173 may include one or more breach lock tabs 175 adapted to engage with breach lock slots 165 of lock ring 161. In such an embodiment, spacer spool pipe 171 may be coupled to diverter lower assembly 151 by axially engaging the two members and inserting breach lock tabs 175 into breach lock slots 165 of lock ring 161. Lock ring 161 may then be rotated such that breach lock slots 165 engage breach lock tabs 175, retaining diverter lower assembly 151 to spacer spool pipe 171.

In some embodiments, spacer spool pipe 171 may include lock ring retainer 205. Lock ring retainer 205 may be a generally annular protrusion from the exterior surface of spacer spool pipe 171. Lock ring retainer 205 may, for example, retain lock ring 201 to spacer spool pipe 171 as discussed above with respect to diverter lower assembly. Lock ring 201 may include retaining flange 203 adapted to contact lock ring retainer 205 and prevent lock ring 201 from sliding off the end of spacer spool pipe 171.

In some embodiments, spacer spool pipe 171 may couple to overshot housing 181. In some embodiments, overshot housing 181 may include upper coupler 183. In some embodiments upper coupler 183 may include one or more overshot breach lock tabs 185 adapted to engage with overshot breach lock slots 165 of overshot lock ring 161. In such an embodiment, overshot housing 181 may be coupled to spacer spool pipe 171 by axially engaging the two members and inserting overshot breach lock tabs 185 into overshot breach lock slots 165 of overshot lock ring. Overshot lock ring 161 may then be rotated such that overshot breach lock slots 165 engage overshot breach lock tabs 185, retaining spacer spool pipe 171 to overshot housing 181.

In some embodiments, as shown in FIG. 9, overshot housing 181 may be adapted to slip over a casing portion or riser, depicted as mandrel 191. Overshot housing 181 may be tubular and may include a plurality of seals 187 positioned within annular grooves 189 formed on the inner surface thereof. Seals 187 may serve to provide a fluid seal between mandrel 191 and diverter assembly bore 104. In some embodiments, two or three seals 187 may be utilized. In some embodiments, mandrel 191 may include lower coupler 197. Lower coupler 197 may allow mandrel 191 to couple to additional drilling components. In some embodiments, lower coupler 197 may include coupler flange 199.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A diverter assembly, comprising:

a diverter body, wherein the diverter body is fluidly coupled to an annulus of a wellbore; and a packer sleeve assembly mechanically coupled to the diverter body, wherein the packer sleeve assembly is removable from the diverter body, wherein the packer sleeve assembly comprises a plurality of inflatable inner seals, wherein the plurality of inflatable inner seals is positioned on an inner surface of the packer sleeve assembly;

wherein the packer sleeve assembly comprises a plurality of inflatable outer seals, wherein the plurality of inflatable outer seals is positioned on an outer surface of the packer sleeve assembly.

2. The diverter assembly of claim 1, wherein the plurality of inflatable outer seals is arranged to form a fluid seal between the packer sleeve assembly and the diverter body.

3. The diverter assembly of claim 1, wherein the plurality of inflatable inner seals is arranged to form a fluid seal between the packer sleeve assembly and a drill string or casing.

4. The diverter assembly of claim 3, wherein the plurality of inflatable inner seals is configured to seal against multiple pipe diameters of the drill string or casing.

5. The diverter assembly of claim 1, wherein each of the plurality of inflatable inner seals and the plurality of inflatable outer seals is adapted to be inflated simultaneously.

6. The diverter assembly of claim 1, wherein each of the plurality of inflatable inner seals and the plurality of inflatable outer seals is adapted to be inflated selectively independently.

7. The diverter assembly of claim 1, wherein the amount of the plurality of inflatable inner seals is the same as the amount of the plurality of inflatable outer seals.

8. The diverter assembly of claim 1, wherein the plurality of inflatable inner seals and the plurality of outer seals is configured to be inflated by fluid actuation.

9. The diverter assembly of claim 1, wherein the plurality of inflatable inner seals and the plurality of outer seals is adapted to be serviced by the removal of the packer sleeve assembly from the diverter body.

10. The diverter assembly of claim 1, wherein the plurality of inflatable inner seals and the plurality of outer seals is adapted to be repaired by the removal of the packer sleeve assembly from the diverter body.

11. The diverter assembly of claim 1, wherein the packer sleeve assembly is removable from the diverter body by axial rotation of the packer sleeve assembly.

12. The diverter assembly of claim 1, wherein the packer sleeve assembly is removable from the diverter body along an axis of the packer sleeve assembly.

13. The diverter assembly of claim 1, wherein the packer sleeve assembly is configured to be axially coupled to or removed from the diverter body by a breach lock assembly, wherein the breach lock assembly comprises one or more breach lock tabs and one or more breach lock slots.

14. The diverter assembly of claim 1, wherein the packer sleeve assembly comprises one or more breach lock tabs, wherein the diverter body comprises one or more breach lock slots.

15. The diverter assembly of claim 14, wherein the packer sleeve assembly is configured to be axially coupled to or removed from the diverter body by engagement of the one or more breach lock tabs to the one or more breach lock slots.

* * * * *